United States Patent [19]

Rich et al.

[11] Patent Number: 4,659,320

[45] Date of Patent: Apr. 21, 1987

[54] TOY VEHICLE WITH DISC LAUNCHING APPARATUS AND DISKS

[75] Inventors: Hubert A. Rich, Westminster; Miva A. Filoseta, Los Angeles; Eric C. Ostendorff, Torrance, all of Calif.

[73] Assignee: Mattel, Inc., Hawthorne, Calif.

[21] Appl. No.: 781,608

[22] Filed: Sep. 27, 1985

[51] Int. Cl.[4] ..... A63H 33/18; F41B 3/02

[52] U.S. Cl. ..... 446/435; 124/16; 124/42; 124/47; 273/424

[58] Field of Search ..... 446/308, 429, 435; 124/4, 6, 7, 16, 42, 46, 47; 273/126 R, 129 V, 364, 424

[56] References Cited

U.S. PATENT DOCUMENTS

| | | | |
|---|---|---|---|
| 2,206,240 | 7/1940 | Skreberg | 124/4 |
| 2,624,977 | 3/1950 | Baker | 446/429 |
| 2,742,889 | 4/1956 | Clauss | 124/26 |
| 3,148,478 | 9/1964 | Miller | 446/435 |
| 3,701,216 | 10/1972 | Smith et al. | 446/429 |
| 3,807,738 | 4/1974 | Breslow | 273/126 R |
| 4,030,472 | 6/1977 | Watkins | 124/42 X |
| 4,248,202 | 2/1981 | Jaworski et al. | 124/16 |
| 4,429,677 | 2/1984 | Moore | 273/424 X |

FOREIGN PATENT DOCUMENTS

| | | | |
|---|---|---|---|
| 1186377 | 1/1965 | Fed. Rep. of Germany | 273/126 R |

*Primary Examiner*—Richard T. Stouffer

*Attorney, Agent, or Firm*—Ronald M. Goldman; Melvin A. Klein; Daniel F. Sullivan

[57] ABSTRACT

A toy vehicle disk launching apparatus for launching small disks in spinning fashion into a surface for accelerated travel therealong. A chassis supported by wheels includes a housing having a track for loading disks with spindle portions on the axis thereof to a disk launching station. At the disk launching station is an arc shaped catapult lever pivotally mounted for contacting a spindle position of the disk for imparting spinning motion thereto thereby launching the disk onto the surface.

6 Claims, 6 Drawing Figures

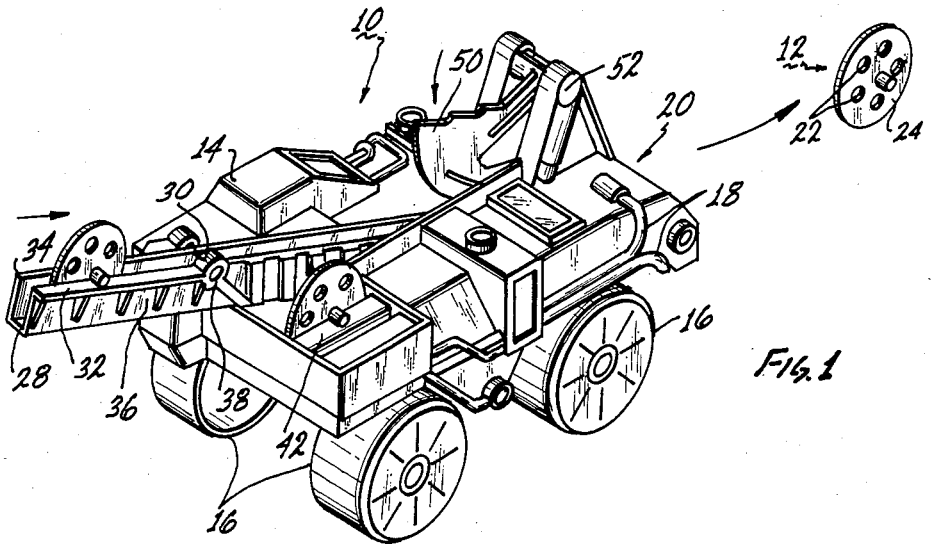
FIG. 1
FIG. 2
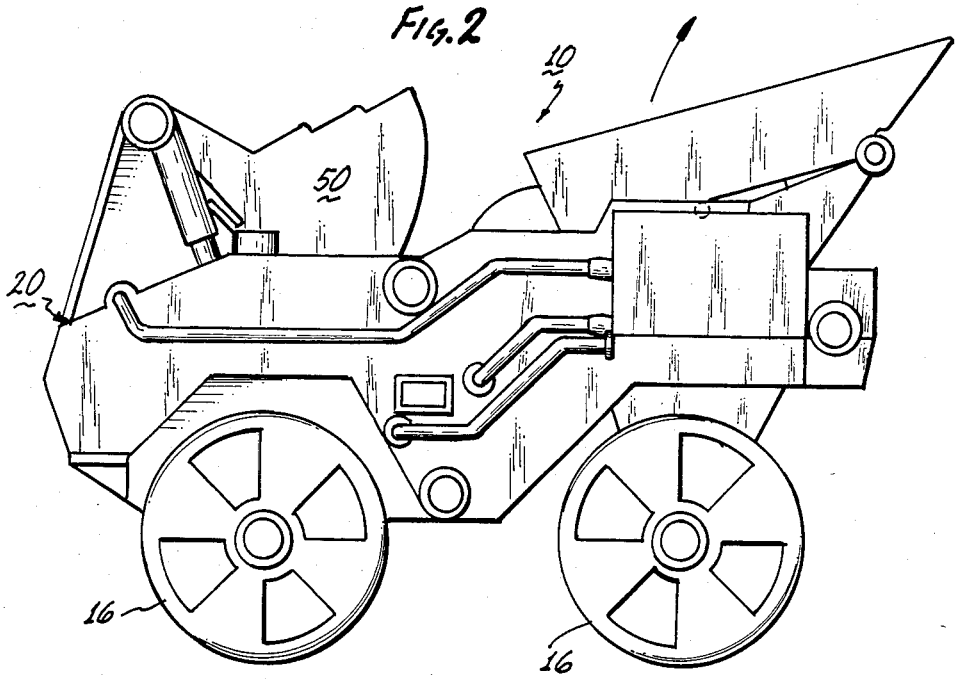

TOY VEHICLE WITH DISC LAUNCHING APPARATUS AND DISKS

BACKGROUND OF THE INVENTION

1. Field of the Invention

The apparatus of the present invention generally relates to toys and in particular to a toy vehicle for launching disks.

2. Description of the Prior Art

U.S. Pat. No. 2,624,977 shows a cord impelled rotatable disk toy that may be easily spun at a high velocity and droped to the ground to race away on its peripheral surface.

U.S. Pat. No. 2,742,889 shows a device for launching disk like projectiles from an impeller in a catapult like manner.

U.S. Pat. No. 3,701,216 shows a toy apparatus in which a rotary launcher is used to propel a wheel.

U.S. Pat. No. 4,248,202 shows a toy launcher for propelling round disks in which the actuating arm moves in a circular path for ejecting the disks.

SUMMARY OF THE INVENTION

A principle object of the present invention is to provide a new and improved toy disk launching apparatus.

Another object of the present invention is to provide a new and improved toy vehicle for launching toy disks.

Another object of the present invention is to provide a safe and simple construction for a disk launching apparatus capable of repeatedly launching disks on a surface along which the periphery of the disk surface are rolled at accelerated speeds upon being launched.

Another object of the present invention is to provide new and improved toy disk launching apparatus for repeatedly launching disk in seriatim along a surface in a safe and reliable manner.

The invention briefly stated is for a new and improved disk launching apparatus for rapidly launching disks onto a surface from a vehicle. The disks have spindle portions on the axis thereof that are used for launching the disks onto a receiving surface in a spinning motion. On one side of the disk is a relatively long spindle portion and on the other side of the disk is a relatively short spindle portion. The disk launching apparatus includes a housing that is mounted on a chassis with wheels. The housing includes an inclined track for receiving the spindle portions of the disks. The track includes an elongated channel for receiving the disk portion below the spindle portions.

A catapult lever is pivotably mounted at the end of the track overlying the path of the relatively long spindle portion. The lever has a segmented portion with a peripheral surface that engages the relatively long spindle portion of the disk at a disk launching station. Upon pivotal movement of the catapult lever the peripheral surface of the catapult lever engages the relatively long spindle portion of the disk causing the disk to rotate and be ejected from the catapult launching apparatus upon release of the peripheral surface from the spindle portion. As a result the disk is rolled onto a relatively flat receiving surface where the disk accelerates upon contacting the surface.

BRIEF DESCRIPTION OF THE DRAWINGS

FIG. 1 is a perspective view of the toy disk launching apparatus according to the present invention;

FIG. 2 is a side elevation view of the apparatus;

DESCRIPTION OF THE PREFERRED EMBODIMENT

Figures 3, 4:
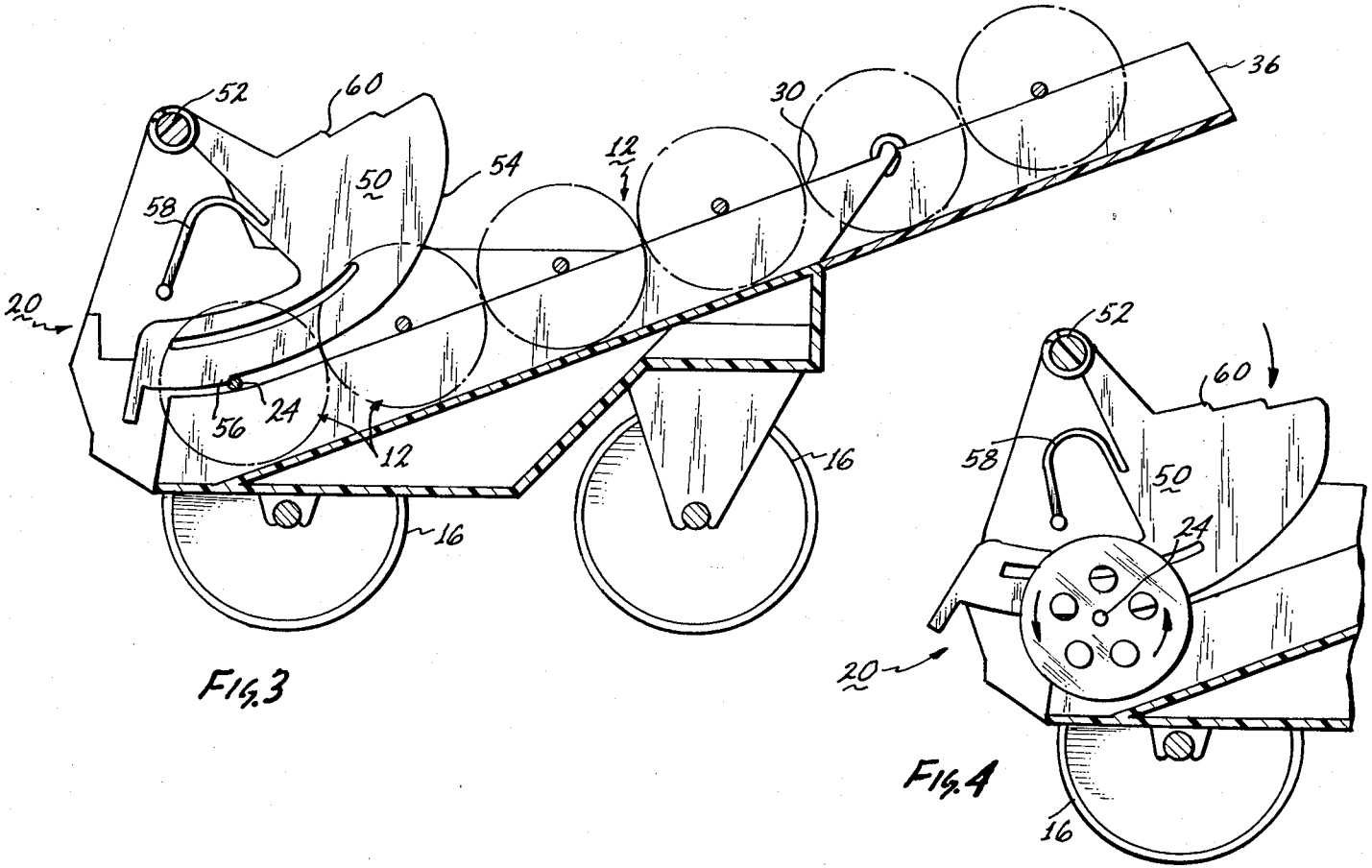
FIG. 3 is a partial side sectional view of the apparatus illustrating certain details thereof.
FIG. 4 is an exploded sectional view of the disk at the launch position illustrating certain details thereof.

Referring now to FIGS. 1–6 that is shown the toy vehicle disk launching apparatus generally designated 10 for launching disks 12 in accordance with the present invention. Disk launching apparatus 10 includes a chassis 14 having wheels 16 for movement along the surface by a young child to position the apparatus for the launching of disks 12 onto the surface. The chassis 14 has a configuration which simulates a power plant made up of various components connected by conduits 18.

Positioned on one end of the chassis is a disk launching station 20 at which the disks are launched in a spinning motion onto the surface supporting the toy vehicle. It will be appreciated that as the spinning disks 12 contact the surface the disks accelerate and travel long distances to the amusement of the child playing with the apparatus.

Figures 5, 6:
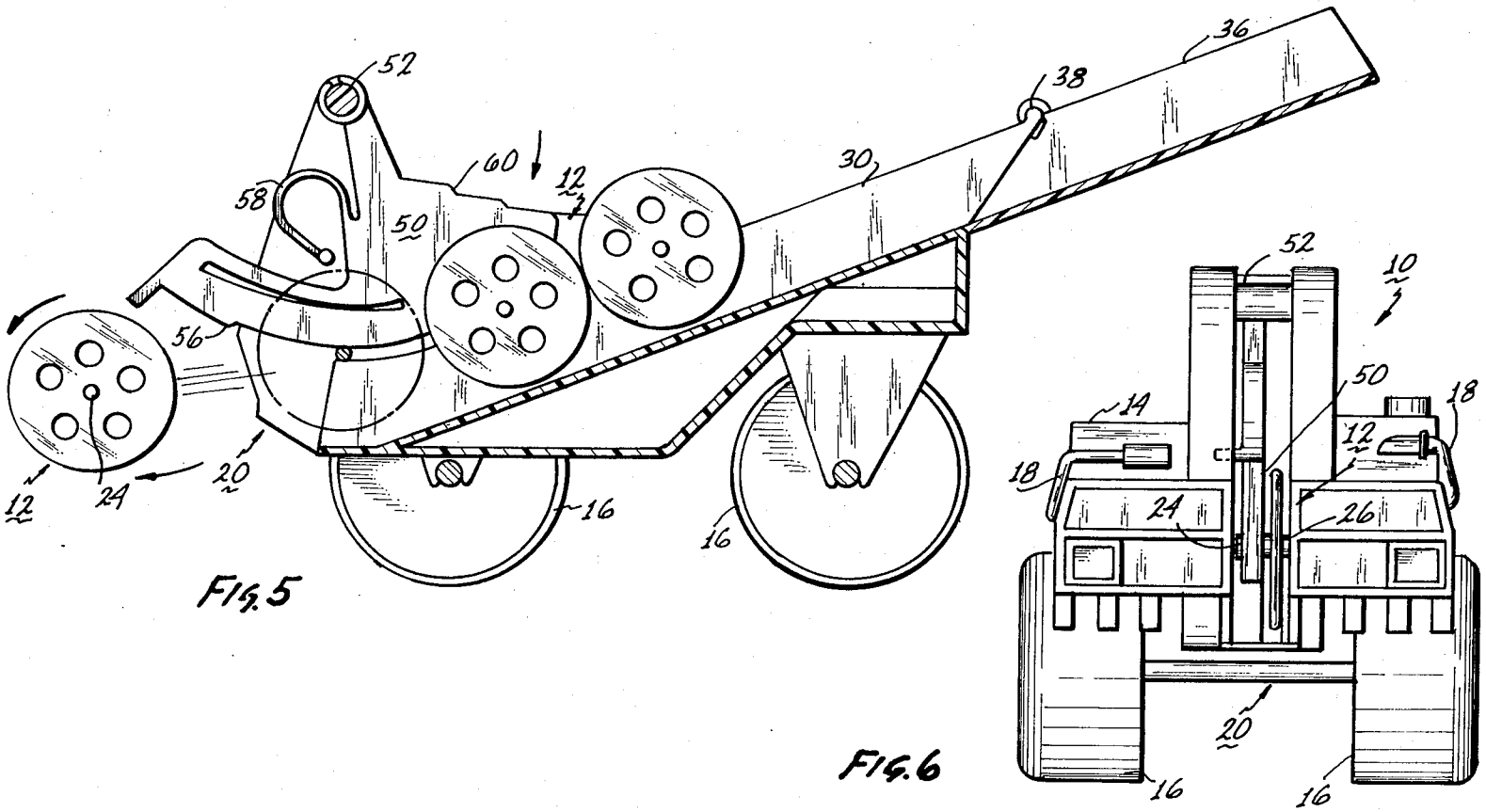
FIG. 5 is a side sectional view of the disk launching apparatus similar to FIG. 3 illustrating the launching of the disk.
FIG. 6 is an end view of the apparatus illustrating details of the disk launching station.

Each of the disks has a circular shape with openings 22 formed therein and are made from any suitable light weight material, such as, plastic. On one side of the disk on the axis of rotation is a relatively long spindle portion 24 and on the opposite side of the disk on the axis thereof is a relatively short spindle portion 26 (FIG. 6). The spindle portions are used for loading the disks and then launching the disks from the disk launching station as will become more fully understood hereinafter.

For loading the disk members into the disk launching station there is a track 30 with a relatively wide surface 32 for supporting the relatively long spindle portion 24 and a relatively narrow surface 34 for supporting the relatively short spindle portion 26 with a channel 35 formed between surfaces 32 and 34. The track 30 has a extensible section 36, pivotably mounted on an axis of a pin 38 (FIG. 1) for extending the track to accommodate additional disk members or for folding in a retracted position (FIG. 2). Formed on the chassis are small channel spaces 42 for accomondating single disk members for storage purposes. It will be appreciated that the track 30 is inclined to the surface supporting the chassis 14 so that the disks may be advanced by gravity into a loading position at the disk launching station 20.

Positioned at the disk launching station is a catapult lever 50 that is pivotably mounted on a pin 52 supported by the chassis. The catapult lever 50 is in the shape of an arc or circular segment extending for about 90. The lever has a peripheral surface 54 that is positioned to engage the relatively long spindle portion 26 of the disk loaded for firing at the disk launching station 20. Formed on the peripheral surface of the catapult lever is a protuberance 56 that serves as a stop for the lowermost disk at the disk launching station (FIG. 3). The catapult lever 50 has a leaf spring 58 connected to the catapult lever at one end and to the chassis at the other end to position the catapult lever at its start position for the disk launching operation. Upon pivotably moving the catapult lever to launch the disk (FIG. 4) the peripheral surface 54 engages the relatively long spindle portion 26 of the disk member imparting a spinning movement thereto as the catapult lever is moved forwardly. The ratio of the peripheral surface of the lever to the relatively long spindle portion is preferably about 40 to 1. When the catapult lever is in its most forward position the peripheral surface 54 is released from the relatively long spindle portion 26 of the disk and the disk is ejected from the disk launching apparatus in a spinning motion onto the surface. Leaf spring 58 serves to return the catapult lever to its original start position. At this time the next disk is being loaded for launching from the disk launching station in the manner previously described.

Catapult lever 50 has a serrated surface 60 at one end to facilitate the repeated pushing of the catapult lever to launch multiple disks repeatedly in seriatim. Each time leaf spring 58 returns the lever to the start position for the next disk. The disks, catapult lever, and leaf spring are preferably all made of plastic material.

It will now be appreciated that a young child may amuse himself by moving the toy vehicle to a position on a surface for launching small disks in repeated fashion. When the disks strike the surface in a spinning motion the disks are then accelerated and travel long distances all to the delight of the young child.

From the foregoing description it will become apparent that a toy is provided that will fulfill all the necessary requirements of such a device and that changes can be made without departing from the spirit or scope of the invention. Thus it is to be understood that within the scope of the appended claims, the invention may be practiced otherwise than as specifically described above.

We claim:

1. In a toy vehicle with wheels having a chassis on which a disk launching apparatus is mounted, the improvement for the disk launching apparatus comprising;

a track mounted on said chassis including a first surface and a second surface separated by a channel, a plurality of small disk members adapted to be received in said channel, each disk member having a relatively long spindle portion for contacting said first surface and a relatively short spindle portion for contacting said second surface, a launching station at one end of said track, said track being inclined to direct the leading disk member to the launching station;

a catapult lever positioned on the chassis at the launching station and having a segmented peripheral surface facing the track and engaging the relatively long spindle portion of the disk member at the launching station, said wheels having an axis, said catapult lever being pivotally mounted on an axis parallel to the axis of the wheels whereupon imparting pivotal movement to the catapult lever causes a spinning movement to be imparted to said lead disk member thereby launching the spinning disk member upon release of the segmented peripheral surface from the disk member.

2. A toy vehicle disk launching apparatus according to claim 1 including a leaf spring connected to said chassis and said catapult lever for biasing against pivotal movement of the catapult lever and returning the lever to its start position.

3. A toy vehicle disk launching apparatus according to claim 1 wherein said peripheral surface of said lever includes a protuberance for engaging the relatively long spindle portion of the disk member at the launching station.

4. A toy vehicle disk launching apparatus according to claim 1 wherein said track includes an extension for accommodating additional disk members.

5. A toy vehicle disk launching apparatus according to claim 1 wherein the ratio of the peripheral surface of the lever to the relatively long spindle portion is about 40 to 1.

6. A toy vehicle disk launcher according to claim 1 wherein said disk members, catapult lever and leaf spring are made of plastic material.

* * * * *